US009770745B2

(12) United States Patent
Breuer et al.

(10) Patent No.: US 9,770,745 B2
(45) Date of Patent: Sep. 26, 2017

(54) ROLL STAND, PARTICULARLY PUSH ROLL STAND

(75) Inventors: Michael Breuer, Hilchenbach (DE); Hendrik Langer, Schmallenberg (DE); Jochen Muenker, Kreuztal (DE)

(73) Assignee: SMS SIEMAG AG, Duesseldorf (DE)

( * ) Notice: Subject to any disclaimer, the term of this patent is extended or adjusted under 35 U.S.C. 154(b) by 825 days.

(21) Appl. No.: 12/600,313

(22) PCT Filed: Feb. 9, 2009

(86) PCT No.: PCT/EP2009/000874
§ 371 (c)(1),
(2), (4) Date: Nov. 16, 2009

(87) PCT Pub. No.: WO2009/103436
PCT Pub. Date: Aug. 27, 2009

(65) Prior Publication Data
US 2011/0154877 A1 Jun. 30, 2011

(30) Foreign Application Priority Data
Feb. 19, 2008 (DE) ..... 10 2008 009 902

(51) Int. Cl.
*B21B 31/30* (2006.01)
*B21B 31/20* (2006.01)
*B21B 31/32* (2006.01)

(52) U.S. Cl.
CPC ..... *B21B 31/30* (2013.01); *B21B 31/20* (2013.01); *B21B 31/32* (2013.01)

(58) Field of Classification Search
USPC .. 72/241.2, 242.2, 243.2, 226, 241.4, 241.6, 72/245, 246, 248
See application file for complete search history.

(56) References Cited

U.S. PATENT DOCUMENTS 1,614,424 A * 1/1927 Coe ..... 72/242.2
1,636,057 A * 7/1927 Jones ..... 72/248
1,739,156 A * 12/1929 Lindquist ..... 72/241.2
1,779,195 A * 10/1930 Steckel ..... 72/29.1
1,860,931 A * 5/1932 Keller ..... 72/241.4
(Continued)

FOREIGN PATENT DOCUMENTS

JP 6269818 9/1994
JP 2004314174 A 11/2004

OTHER PUBLICATIONS

CVC 4-HS-Kaltwalzanlage ARBED fuer hochwertiges Stahlband, SMS, Germany.

*Primary Examiner* — David Bryant
*Assistant Examiner* — Lawrence Averick
(74) *Attorney, Agent, or Firm* — Andrew Wilford

(57) ABSTRACT

The invention relates to a roller device (50) having a stand and two roller sets having at least two rollers (52, 53, 54, 55) disposed in a stand (51) of the roller device, wherein a roll material (56) can be fed between two rollers (53, 54) of the two roller sets for rolling, wherein at least the rollers (52, 53) of a roller set can be displaced in the rolling direction relative to the stand (51), wherein adjustment means are provided between a roller bearing for receiving the rollers and the stand, each on both sides of the roller bearing. It is thereby particularly advantageous if the circumferential speeds of the rollers, such as the working rollers, are different.

8 Claims, 3 Drawing Sheets

(56) References Cited

U.S. PATENT DOCUMENTS

| | | | | | |
|---|---|---|---|---|---|
| 1,864,299 | A | * | 6/1932 | Fawell | 72/243.6 |
| 1,892,933 | A | * | 1/1933 | Coryell | 72/241.2 |
| 1,900,344 | A | * | 3/1933 | Iversen | 72/241.2 |
| RE18,992 | E | * | 11/1933 | Iversen | 72/241.2 |
| 2,025,002 | A | * | 12/1935 | McIlvried | 72/229 |
| 2,139,872 | A | | 5/1937 | Worthington | |
| 2,157,455 | A | * | 5/1939 | Kimmel | 72/241.2 |
| 2,271,459 | A | * | 1/1942 | McConnell | 72/241.2 |
| 2,287,851 | A | * | 6/1942 | Zeitlin | 72/11.8 |
| 2,767,602 | A | * | 10/1956 | Henrickson | 72/242.2 |
| 2,792,730 | A | * | 5/1957 | Cozzo | 72/9.4 |
| 2,922,325 | A | * | 1/1960 | Forster | 72/201 |
| 3,077,800 | A | * | 2/1963 | Taylor | 72/10.1 |
| 3,164,044 | A | * | 1/1965 | Trapp | 72/241.2 |
| 3,171,304 | A | * | 3/1965 | Sims et al. | 72/238 |
| 3,233,445 | A | * | 2/1966 | Norlindh | 72/240 |
| 3,242,711 | A | * | 3/1966 | Fox | 72/241.2 |
| 3,247,697 | A | * | 4/1966 | Cozzo | 72/240 |
| 3,307,386 | A | * | 3/1967 | Ward et al. | 72/241.2 |
| 3,310,971 | A | * | 3/1967 | Tanaka et al. | 72/9.5 |
| 3,431,762 | A | * | 3/1969 | O'Brien | 72/14.4 |
| 3,501,936 | A | * | 3/1970 | Stubbs | 72/241.2 |
| 3,546,914 | A | | 12/1970 | Leifeld et al. | |
| 3,665,743 | A | * | 5/1972 | Frohling | 72/11.8 |
| 3,693,393 | A | * | 9/1972 | Nellen et al. | 72/226 |
| 3,740,982 | A | * | 6/1973 | Hacker et al. | 72/12.2 |
| 3,811,307 | A | | 5/1974 | Vydrin et al. | |
| 4,237,714 | A | * | 12/1980 | Polukhin et al. | 72/242.2 |
| 4,385,511 | A | | 5/1983 | Vydrin | |
| 4,402,207 | A | * | 9/1983 | Buder | 72/241.2 |
| 4,453,393 | A | * | 6/1984 | Hino et al. | 72/241.8 |
| 4,548,064 | A | * | 10/1985 | Bohnenkamp | 72/236 |
| 4,580,428 | A | * | 4/1986 | Brettbacher et al. | 72/226 |
| 4,599,883 | A | * | 7/1986 | Ginzburg et al. | 72/234 |
| 4,631,948 | A | | 12/1986 | Bald et al. | |
| 4,736,609 | A | | 4/1988 | Schiller et al. | |
| 4,805,492 | A | * | 2/1989 | Tsuruda | 72/9.1 |
| 4,918,965 | A | * | 4/1990 | Kobayashi et al. | 72/243.2 |
| 4,976,128 | A | * | 12/1990 | Tajima | 72/238 |
| 5,038,591 | A | * | 8/1991 | Tajima et al. | 72/13.4 |
| 5,291,770 | A | * | 3/1994 | Koujin et al. | 72/237 |
| 5,560,237 | A | * | 10/1996 | Yasuda et al. | 72/13.4 |
| 5,765,424 | A | * | 6/1998 | Mantovan | 72/245 |
| 5,809,821 | A | * | 9/1998 | Figge | 72/247 |
| 5,924,319 | A | | 7/1999 | Ginzburg | 72/247 |
| 6,085,567 | A | * | 7/2000 | Cattaneo et al. | 72/237 |
| 6,151,943 | A | * | 11/2000 | Nihei et al. | 72/241.2 |
| 6,250,126 | B1 | * | 6/2001 | Yasuda et al. | 72/241.2 |
| 6,266,988 | B1 | * | 7/2001 | Kimura et al. | 72/237 |
| 6,354,128 | B1 | * | 3/2002 | Donini et al. | 72/237 |
| 6,510,721 | B1 | * | 1/2003 | Yamamoto et al. | 72/245 |
| 6,820,453 | B2 | | 11/2004 | Takahashi et al. | |
| 6,895,794 | B2 | | 5/2005 | Yamamoto et al. | |
| 6,959,571 | B2 | | 11/2005 | Yamamoto et al. | |
| 7,188,496 | B2 | * | 3/2007 | Karam et al. | 72/13.4 |
| 7,225,657 | B2 | * | 6/2007 | Slawinski | 72/245 |
| 7,251,978 | B2 | * | 8/2007 | Seidel et al. | 72/247 |
| 7,491,276 | B2 | * | 2/2009 | Wehage et al. | 148/541 |
| 7,757,531 | B2 | * | 7/2010 | Klockner et al. | 72/252.5 |
| 7,895,871 | B2 | * | 3/2011 | Zieser et al. | 72/245 |
| 2002/0078729 | A1 | * | 6/2002 | Bunten | 72/241.2 |
| 2003/0019271 | A1 | * | 1/2003 | Yamamoto et al. | 72/245 |
| 2003/0024293 | A1 | * | 2/2003 | Yamamoto et al. | 72/245 |
| 2003/0101787 | A1 | * | 6/2003 | Takahashi et al. | 72/241.2 |
| 2004/0040358 | A1 | * | 3/2004 | Seidel et al. | 72/243.2 |
| 2004/0187538 | A1 | * | 9/2004 | Denker | 72/245 |
| 2005/0247095 | A1 | * | 11/2005 | Slawinski | 72/245 |
| 2006/0254335 | A1 | * | 11/2006 | Turley | 72/243.2 |
| 2007/0051153 | A1 | * | 3/2007 | Breuer et al. | 72/229 |
| 2007/0245794 | A1 | | 10/2007 | Brandenfels et al. | |
| 2008/0115551 | A1 | * | 5/2008 | Marc et al. | 72/226 |
| 2008/0250836 | A1 | * | 10/2008 | Gouttebroze et al. | 72/246 |
| 2008/0271508 | A1 | * | 11/2008 | Kruger et al. | 72/12.3 |
| 2009/0183544 | A1 | * | 7/2009 | Pawelski et al. | 72/241.2 |
| 2010/0252223 | A1 | * | 10/2010 | Franz et al. | 164/131 |
| 2010/0288007 | A1 | * | 11/2010 | Ogawa et al. | 72/241.6 |
| 2010/0300170 | A1 | * | 12/2010 | Bentoski et al. | 72/211 |
| 2011/0000271 | A1 | * | 1/2011 | Ogawa et al. | 72/241.2 |
| 2011/0005290 | A1 | * | 1/2011 | Norikura | 72/234 |
| 2011/0132055 | A1 | * | 6/2011 | Diehl et al. | 72/245 |
| 2011/0239723 | A1 | * | 10/2011 | Diehl et al. | 72/241.2 |

* cited by examiner

ROLL STAND, PARTICULARLY PUSH ROLL STAND

CROSS REFERENCE TO RELATED APPLICATIONS

This application is the US national stage of PCT application PCT/EP2009/000874, filed 9 Feb. 2009, published 27 Aug. 2009 as WO2009/103436, and claiming the priority of German patent application 102008009902.3 itself filed 19 Feb. 2008, whose entire disclosures are herewith incorporated by reference.

FIELD OF THE INVENTION

The invention relates to a roll stand, in particular a pusher-type roll stand for flat rolling and having a frame and two sets each having two or more rolls mounted in the frame of the roll stand so that a workpiece can be fed between two rolls of the two sets for rolling.

PRIOR ART

Roll stands are well known in the prior art. A roll stand for flat rolling usually symmetrically deforms the workpiece between working rolls. To this end the roll diameter, the peripheral speed, and the frictional conditions of both working rolls are made as equal as possible such that only the slightest variations are present. Such roll stands have become known, for example, from DE 33 23 641 [U.S. Pat. No. 4,631,948].

Furthermore, there are roll stands where the peripheral speeds of the two working rolls are different. Such roll stands have become known, for example, from DE 28 33 990 [U.S. Pat. No. 4,385,511]. In so-called push rolls or asymmetrical rolls the processing conditions are chosen to be not equal, but selectively unequal for both working rolls. Although this has the advantage that roll force is reduced due to shear, this also has disadvantages. The disadvantages include the so-called ski effect, that is uneven metal properties across the thickness of the sheet metal, and an uneven loading of the drive trains of the rolls, and thus of their motors.

This also results in the fact that push rolls are normally not used in the production of sheet metal at all, because the disadvantages outweigh the advantages.

OBJECT OF THE INVENTION

The object of the invention is therefore to create a roll stand by means of which the disadvantages of prior art may be reduced, if not even avoided altogether.

SUMMARY OF THE INVENTION

According to the invention the object is attained by a roll stand having a frame and two sets each having two or more rolls mounted in the frame of the roll stand so that a workpiece can be fed between two rolls of the two sets for rolling, and wherein the rolls of at least one of the roll sets are displaceable in a rolling direction relative to the frame, adjustment means being provided on each side between the roll mounts of the one set and the frame.

It is also advantageous if the adjusters are mounted on each side of each of the two rolls.

It is also preferable if the adjusters are mounted essentially horizontally level with the respective roll and/or of the respective roll axis in the direction as viewed perpendicular to the rolling direction.

It is further advantageous, if the displaceable roll set has a common roll mount for its two rolls, the adjusters engaging the roll mount essentially horizontally level with the respective roll in the direction as viewed perpendicular to the rolling direction.

Accordingly, it is advantageous if the upper roll set and/or the lower roll set is displaceable.

According to one aspect according to the invention it is advantageous if at least one roll, such as the working rolls, of the upper roll set and of the lower roll sets have a different diameter.

It is further advantageous if the adjusters have is hydraulic and/or mechanical actuators.

It is also advantageous if the roll axes of the rolls of the roll sets are parallel to each other.

To this end it may also be advantageous if the rolls, such as in particular the working rolls, of both roll sets can be operated at different rotational or peripheral speeds.

Advantageous further improvements are described in the dependent claims.

BRIEF DESCRIPTION OF THE DRAWINGS

The invention is described in further detail below with reference to an illustrated embodiment based on the drawings. Therein.

DETAILED DESCRIPTION

Figure 1:
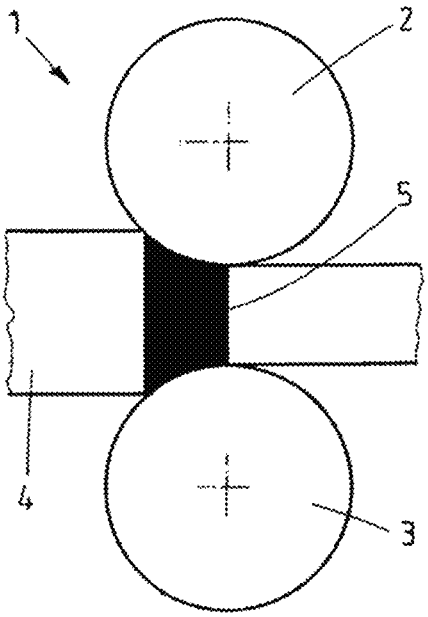
FIG. 1 is a schematic view of working rolls.

FIG. 1 schematically shows at 1 two working rolls 2 and 3 rolling a workpiece 4 with symmetrical orientation of the rolls 2 and 3. To this end a deforming zone 5 of the workpiece 4 is of a symmetrical shape.

Figure 2:
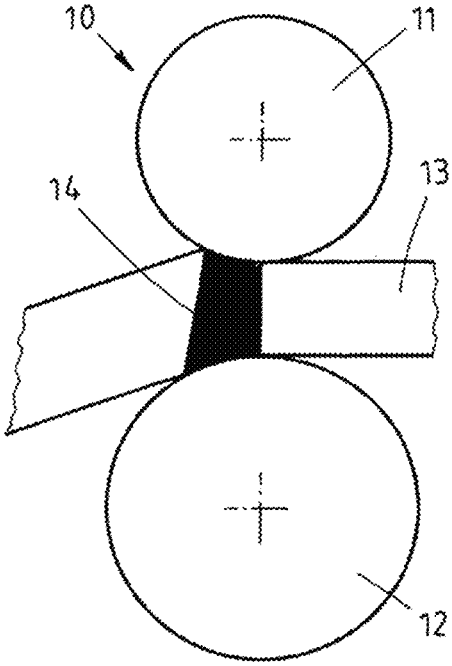
FIG. 2 is a schematic view of working rolls.

FIG. 2 schematically shows at 10 two working rolls 11 and 12 rolling a workpiece 13 with asymmetrical rolling condition but a symmetrical orientation of the rolls 11 and 12. To this end the deforming zone 14 of the workpiece 13 is of an asymmetrical shape. The rolls 11 and 12 are of different sizes. The roll 11 has a smaller diameter than the roll 12. Although the roll arrangement of FIG. 2 has a horizontal workpiece travel path, the workpiece infeed direction is asymmetrical and angled downward toward the second roll 12.

Figure 3:
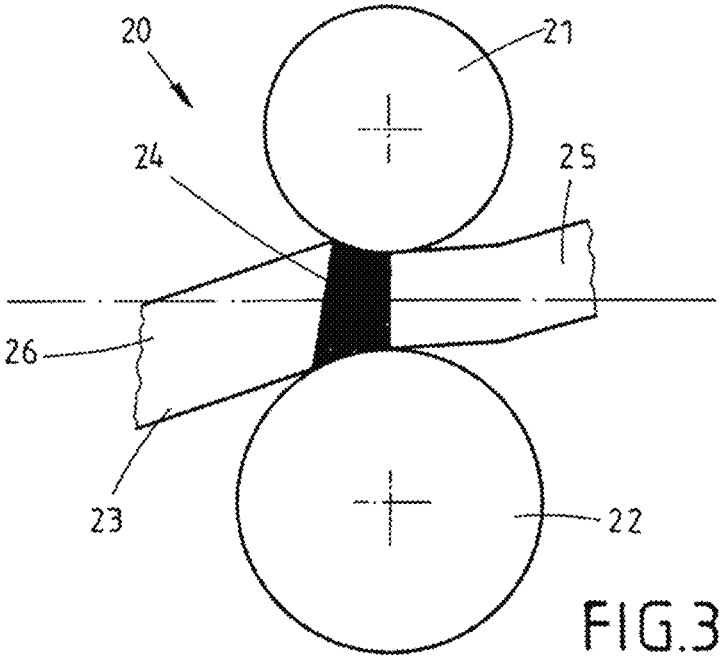
FIG. 3 is a schematic view of working rolls.

FIG. 3 schematically shows at 20 two working rolls 21 and 22 rolling a workpiece 23 with asymmetrical rolling conditions in a symmetrical arrangement of the rolls 21 and 22. To this end a deforming zone 24 of the workpiece 23 is again of an asymmetrical shape. The rolls 21 and 22 are also of different sizes. To this end the roll 21 has a smaller diameter than the roll 22. The roll arrangement of FIG. 3 also has an asymmetrical workpiece travel path 25 and an asymmetrical workpiece infeed direction 26 that is angled downward, and the travel path 25 is angled upward toward the first roll 22. It is clearly visible that the workpiece 23 does not move horizontally through the roll stand, but runs in and out at an angle to the horizontal. The workpiece thus bend as it moves along the travel path 25.

Figure 4:
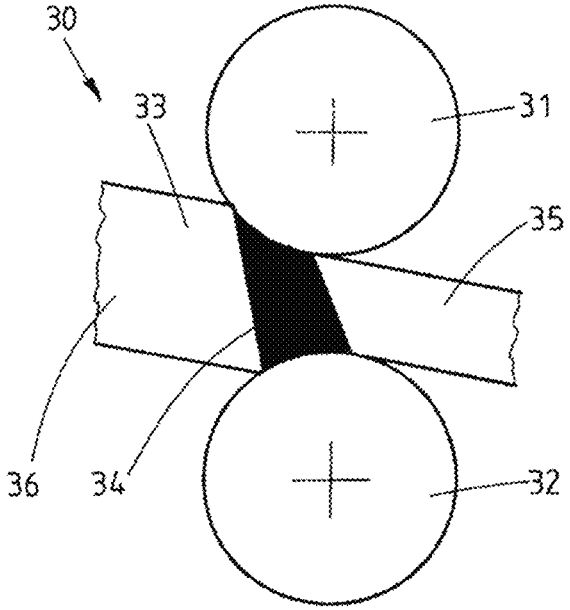
FIG. 4 is a schematic view of working rolls.

FIG. 4 schematically shows at 30 two working rolls 31 and 32 rolling a workpiece 33 with asymmetrical rolling conditions in a symmetrical arrangement of the rolls 31 and 32. To this end the deforming zone 34 of the workpiece 33 is again of an asymmetrical shape. The rolls 31 and 32 are of essentially the same size. The roll arrangement of FIG. 4 also has an asymmetrical workpiece outfeed direction 35 and an asymmetrical workpiece infeed direction 36 that is angled downward, the outgoing travel path 35 also angled downward from above. Again, it is clearly visible that the workpiece 33 does not move on the horizontal through the roll stand, but runs in and out at an angle to the horizontal. The workpiece 33 does not bend as it moves along its travel path 35. This is achieved by the accurately matched adjustment of rolling parameters. For example, the peripheral speeds of the working rolls may be the adjusted roll parameters.

Figure 5:
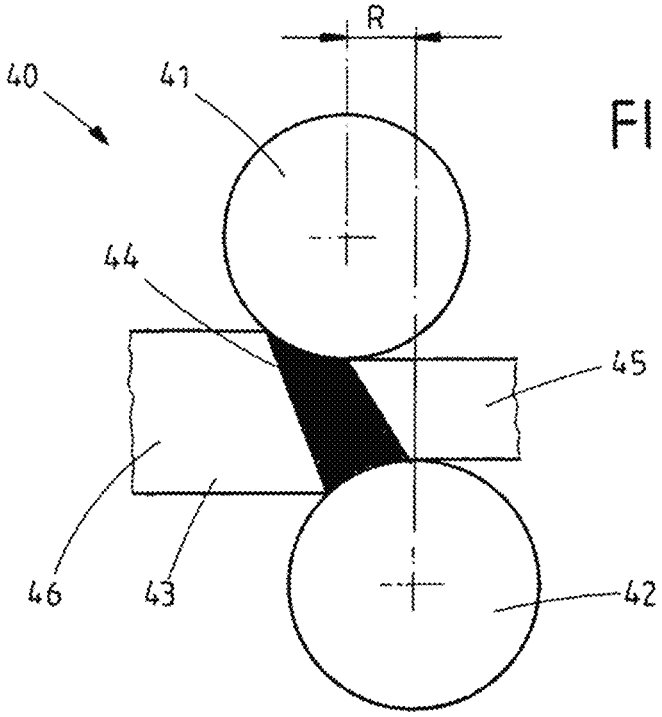
FIG. 5 is a schematic view of working rolls.

FIG. 5 schematically shows at 40 of two working rolls 41 and 42 mounted at an offset to one another, rolling a workpiece 43 with asymmetrical rolling conditions in an offset arrangement of the rolls 41 and 42. The horizontal offset is a dimension R. To this end the deforming zone 44 of the workpiece 43 is again of an asymmetrical shape. The rolls 41 and 42 are of the same size in the embodiment of FIG. 5. The roll arrangement of FIG. 5 also has a horizontal workpiece outfeed direction 45 and a horizontal workpiece infeed direction 46, the infeed direction 46 and the outfeed direction 45 being essentially parallel. The workpiece 43 does not bend as it moves along the travel path 45. The peripheral speeds of the working rolls are also selected accordingly.

Figure 6:
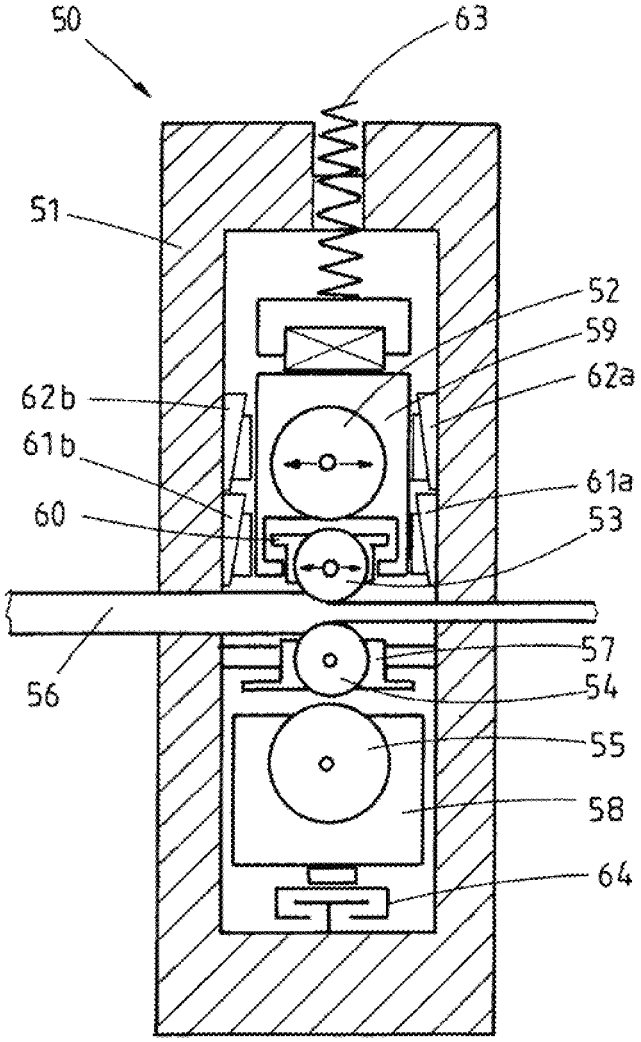
FIG. 6 is a schematic view of a roll stand.

FIG. 6 schematically shows a roll stand 50 where rolls 52, 53, 54, 55 form roll sets 52, 53 and 54, 55 are mounted in a frame 51. To this end an upper roll set 52, 53 and a lower roll set 54, 55 is provided, with working rolls 53 and 54 that roll and deform a workpiece 56 on both faces of the workpiece 56. In the embodiment of FIG. 6 the lower roll set is essentially mounted so that it cannot move in the longitudinal direction of the workpiece 56, its rolls 54 and 55 being supported in respective roll mounts 57 and 58. The rolls 52 and 53 of the upper roll set are advantageously mounted so that the can move in the rolling direction, or in the direction of the extension of the workpiece. To this end the rolls 52 and 53 together with the respective roll mounts 59 and 60 are displaceable by adjusters 61*a*, 61*b*, 62*a*, 62*b*. To this end the adjusters 61*a*, 61*b*, 62*a*, 62*b* may have mechanical and/or hydraulic actuators. They are mounted on both sides of the roll mounts 59 and 60, and serve for supporting the roll mounts 59 and 60 in the frame 51 and for changing the position of the respective rolls 52 and 53 in the rolling direction. The figure further shows a mechanism 63 for mechanical vertically shifting the upper rolls relative to the lower rolls, and a support 64 for the lower rolls.

In a further illustrated embodiment the lower rolls may be displaceable and adjustable in the rolling direction, instead of the upper rolls. In another illustrated embodiment the lower rolls may also be displaceable and adjustable in the rolling direction in addition to the upper rolls.

Due to the adjustability of the roll sets the roll stand may be operated such that the roll sets are not displaced relative to each other in the rolling direction, and also such that the roll sets are displaced relative to each other.

It is of particular advantage in a roll stand according to the invention, such as the device according to FIG. 6, that the displaceable roll set 52 and 53 comprises two or more rolls, adjusters 61*a*, 61*b*, 62*a*, 62*b* being mounted on both sides of each of the two or more rolls 52 and 53. The adjusters 61*a*, 61*b*, 62*a*, 62*b* are essentially mounted horizontally level with the respective rolls 52 and 53. To this end FIG. 6 shows that the center point or the axis of the each roll is positioned approximately level with the respective adjusters 61*a*, 61*b*, 62*a*, 62*b* as viewed in a direction perpendicular to the rolling direction. In FIG. 6 the displaceable roll set 52 and 53 has a common roll mount 59 and 60 for two or more rolls 52 and 53, the adjusters 61*a*, 61*b*, 62*a*, 62*b* engaging the roll mount 59 and 60 essentially horizontally level with the respective rolls as viewed in the direction perpendicular to the rolling direction.

The invention claimed is:

1. A roll stand for flat rolling a workpiece moving in a predetermined direction, the stand comprising:

a frame;

an upper backing roll and an upper working roll forming an upper roll set in the frame and rotatable about respective vertically spaced and parallel upper axes transverse to the direction;

a lower working roll and a lower backing roll below the upper set and forming a lower roll set in the frame below the upper set and rotatable about respective vertically spaced and parallel lower axes transverse to the direction, the working rolls defining a gap through which the workpiece passes in the direction, the working rolls being of smaller diameter than the respective backing rolls, the upper and lower working rolls being of the same diameter, the upper and lower axes all being parallel;

a mount shiftable in the direction on the frame and on which both of the rolls of one of the sets are pivotally mounted; and respective pairs of vertically spaced adjusters braced between the frame and the mount upstream and downstream in the direction and generally level with the axes of the respective rolls of the one set for shifting both of the rolls of the one set in the direction relative to the frame through a horizontal offset between the working rolls of between 50 mm and 120 mm.

2. The roll stand according to claim 1 wherein the roll diameters of the working rolls are between 550 and 1400 mm.

3. The roll stand according to claim 1 wherein the adjusters have hydraulic and/or mechanical actuators.

4. The roll stand according to claim 1 wherein the rotational speeds differ by between 1% and 20%.

5. The roll stand according to claim 1 wherein a reduction of thickness at the workpiece is between 1 mm and 75 mm.

6. The roll stand defined in claim 1, further comprising means for rotating one of the working rolls at a peripheral speed greater than a peripheral speed of the other of the working rolls.

7. The roll stand defined in claim 1 wherein the travel direction extends at at least one side of the frame at an acute angle to a horizontal plane.

8. The roll stand defined in claim 1 wherein the other set of rollers is fixed against shifting in the direction relative to the frame.

* * * * *